US008899693B2

(12) United States Patent
O'Neill et al.

(10) Patent No.: US 8,899,693 B2
(45) Date of Patent: Dec. 2, 2014

(54) MATERIAL GUIDE ASSEMBLY

(75) Inventors: Michael L. O'Neill, Lucinda, PA (US); Josh Lutz, Mercer, PA (US)

(73) Assignee: Joy MM Delaware, Inc., Wilmington, DE (US)

( * ) Notice: Subject to any disclaimer, the term of this patent is extended or adjusted under 35 U.S.C. 154(b) by 126 days.

(21) Appl. No.: 13/449,992

(22) Filed: Apr. 18, 2012

(65) Prior Publication Data

US 2012/0267940 A1 Oct. 25, 2012

Related U.S. Application Data

(60) Provisional application No. 61/517,623, filed on Apr. 22, 2011.

(51) Int. Cl.
*E21C 35/20* (2006.01)
*E21C 27/10* (2006.01)

(52) U.S. Cl.
CPC ..... *E21C 27/10* (2013.01); *E21C 35/20* (2013.01)
USPC ..... 299/43; 299/45

(58) Field of Classification Search
USPC ..... 299/43, 45
See application file for complete search history.

(56) References Cited

U.S. PATENT DOCUMENTS 1,259,050 A 3/1918 Scofield et al.
2,767,970 A * 10/1956 Paul ..... 299/44
3,578,811 A 5/1971 Bassier
3,897,110 A * 7/1975 Agnew ..... 299/45
3,945,680 A * 3/1976 Henrich et al. ..... 299/43
3,958,830 A 5/1976 Johns
4,043,701 A 8/1977 Jaeger
4,068,894 A 1/1978 Dring
4,160,566 A 7/1979 McGee et al.

(Continued)

FOREIGN PATENT DOCUMENTS

DE 2458840 6/1976
DE 3151552 C1 * 5/1983

(Continued)

OTHER PUBLICATIONS

Search Report from Great Britain Intellectual Property Office Application No. GB1206961.3 dated Jul. 30, 2012, 3 pages.

(Continued)

*Primary Examiner* — John Kreck
(74) *Attorney, Agent, or Firm* — Michael Best & Friedrich LLP

(57) ABSTRACT

A guide assembly for a longwall shearer. The shearer includes an arm having an arm end and a cutting drum rotatably coupled to the arm end. The cutting drum rotates about a drum axis and engages a mine wall, and the cutting drum has a rear extent arranged in a plane substantially perpendicular to the drum axis. The guide assembly includes a guide member coupled to the arm and operable to guide material won from the mine wall. The guide member has a guide surface extending in a direction non-parallel to the plane and non-parallel to the drum axis. The guide member guides material along the guide surface away from the cutting drum.

28 Claims, 8 Drawing Sheets

(56) References Cited

U.S. PATENT DOCUMENTS

| | | | | |
|---|---|---|---|---|
| 4,166,652 | A | | 9/1979 | Oberste-Beulmann et al. |
| 4,225,186 | A | | 9/1980 | Stratton |
| 4,251,112 | A | | 2/1981 | Krause |
| 4,290,652 | A | | 9/1981 | Legrand |
| 4,382,633 | A | * | 5/1983 | Ludlow et al. ..... 299/33 |
| 4,471,998 | A | * | 9/1984 | Hotger ..... 299/81.2 |
| 4,785,560 | A | | 11/1988 | Hanson |
| 4,889,392 | A | | 12/1989 | Justice et al. |
| 4,944,558 | A | * | 7/1990 | Oberste-Beulmann et al. ..... 299/42 |
| 5,219,208 | A | | 6/1993 | Liao et al. |
| 5,259,692 | A | | 11/1993 | Beller et al. |
| 5,411,433 | A | | 5/1995 | Keller |
| 5,709,597 | A | | 1/1998 | Sarantitis |
| 6,224,164 | B1 | | 5/2001 | Hall et al. |
| 7,325,882 | B2 | | 2/2008 | Sugden et al. |
| 2011/0227397 | A1 | | 9/2011 | de Andrade et al. |

FOREIGN PATENT DOCUMENTS

| | | | | |
|---|---|---|---|---|
| DE | 3625111 | A1 | * | 2/1988 |
| DE | 19620536 | | | 11/1997 |
| EP | 2348189 | | | 7/2011 |
| GB | 707062 | | | 4/1954 |
| GB | 749105 | | | 5/1956 |
| GB | 1350658 | | | 4/1974 |
| GB | 1361002 | | | 7/1974 |
| GB | 1433169 | | | 4/1976 |
| GB | 2050471 | | | 1/1981 |
| PL | 158146 | | | 10/1989 |
| PL | 200542 | | | 1/2009 |

OTHER PUBLICATIONS

Search Report from Polish Intellectual Property Office Application No. P-398875 dated Apr. 19, 2012, 2 pages.

* cited by examiner

MATERIAL GUIDE ASSEMBLY

CROSS-REFERENCE TO RELATED APPLICATION

This application claims the benefit of U.S. Provisional Application No. 61/517,623, filed Apr. 22, 2011, the entire contents of which are incorporated herein by reference.

FIELD

The present invention relates to the field of mining machines. Specifically, the present invention relates to longwall shearing machines.

SUMMARY

Conventional longwall shearers include a chassis, at least one ranging arm, a cutting drum mounted on the ranging arm, and a face conveyor. The ranging arm articulates with respect to the chassis to position the cutting drum in a desired position for engaging a mine wall. The cutting drum rotates about an axis perpendicular to the mine wall and includes vanes extending along the cutting drum. Generally, a machine operator must be directly behind the cutting drum to ensure the drum is positioned properly and functioning properly. The ranging arm can raise the drum to mine material at heights in excess of 20 feet. When the drum is cutting in a high position, debris liberated from the wall is thrown in many directions, including toward the operator's work area, and could thus strike the operator.

In addition, the face conveyor is spaced a distance from the mine wall. In some instances, the conveyor is as far as 1 meter from the cutting drum in order to prevent contact between the conveyor and the cutting drum and to allow the conveyor to articulate as necessary as the longwall shearer advances through a mineral seam. As the cutting drum liberates material from the mine wall, the material scrolls along the vanes and moves toward the conveyor. Upon reaching the end of the vanes of the cutting drum at the end nearest the conveyor, the material falls to the mine floor and accumulates in a "windrow" of material between the mine wall and the conveyor.

The windrow causes difficulty in advancing the conveyor, either by blocking the conveyor or forcing the conveyor to rise up onto the loose material in the windrow. A cowl may be positioned around a circumferential portion of the cutting drum to deflect material that is cast in a direction parallel to the mine wall (radially from the cutting drum), but the windrow develops regardless of whether a cowl is provided. As much as a third of the material liberated from the mine wall may be deposited in the windrow reducing the amount of efficiency of the mining operation.

In one independent embodiment, a guide assembly for a longwall shearer is provided. The shearer includes an arm having an arm end and a cutting drum rotatably coupled to the arm end. The cutting drum rotates about a drum axis and engages a mine wall, and the cutting drum has a rear extent arranged in a plane substantially perpendicular to the drum axis. The guide assembly may generally include a guide member coupled to the arm and operable to guide material won from the mine wall. The guide member may extend substantially perpendicular to the drum axis and may be arranged to not cross the plane.

In another independent embodiment, the guide assembly may generally include a guide member coupled to the arm and operable to guide material won from the mine wall. The guide member may have a guide surface extending in a direction non-parallel to the plane and non-parallel to the drum axis. The guide member may guide material along the guide surface away from the cutting drum.

In yet another independent embodiment, the guide assembly may generally include a hub portion and a guide member. The hub portion may be coupled to the arm and pivotable about a hub axis. The guide member may be connected to and pivotable with the hub portion. The guide member may extend perpendicular to the drum axis and may be arranged to not cross the plane. The guide member may include a flap formed at least partially of a flexible material, and the flap may deflect material won from the mine wall and traveling in a direction non-parallel to the plane.

In still another independent embodiment, a longwall shearer for engaging a mine wall is provided. The shearer may generally include a body, an arm, a cutting drum, and a guide member. The arm includes a first end coupled to the body and a second end. The cutting drum is rotatably coupled to the arm end. The cutting drum rotates about a drum axis and engages a mine wall. The cutting drum has a rear extent arranged in a plane substantially perpendicular to the drum axis. The guide member may be coupled to the arm and operable to guide material won from the mine wall. The guide member may extend substantially perpendicular to the drum axis and may be arranged to not cross the plane.

Other independent aspects of the invention will become apparent by consideration of the detailed description and accompanying drawings.

DETAILED DESCRIPTION

Figure 1:
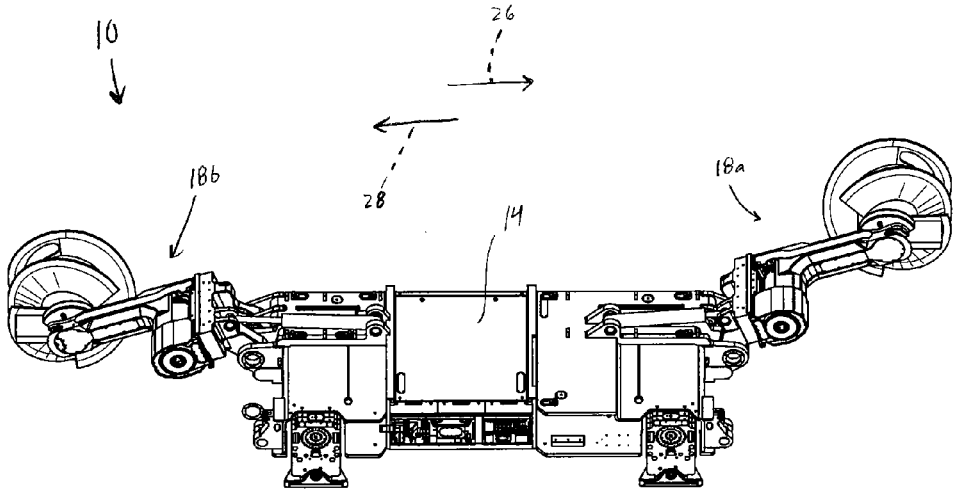
FIG. 1 is a perspective view of a mining machine.

Before any independent embodiments of the invention are explained in detail, it is to be understood that the invention is not limited in its application to the details of construction and the arrangement of components set forth in the following description or illustrated in the following drawings. The invention is capable of other independent embodiments and of being practiced or of being carried out in various ways. Also, it is to be understood that the phraseology and terminology used herein is for the purpose of description and should not be regarded as limiting. The use of "including," "comprising" or "having" and variations thereof is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical connections or couplings, whether direct or indirect. As described in subsequent paragraphs, the specific configurations illustrated in the drawings are intended to exemplify independent embodiments of the invention, and other alternative configurations are possible.

Figure 2:
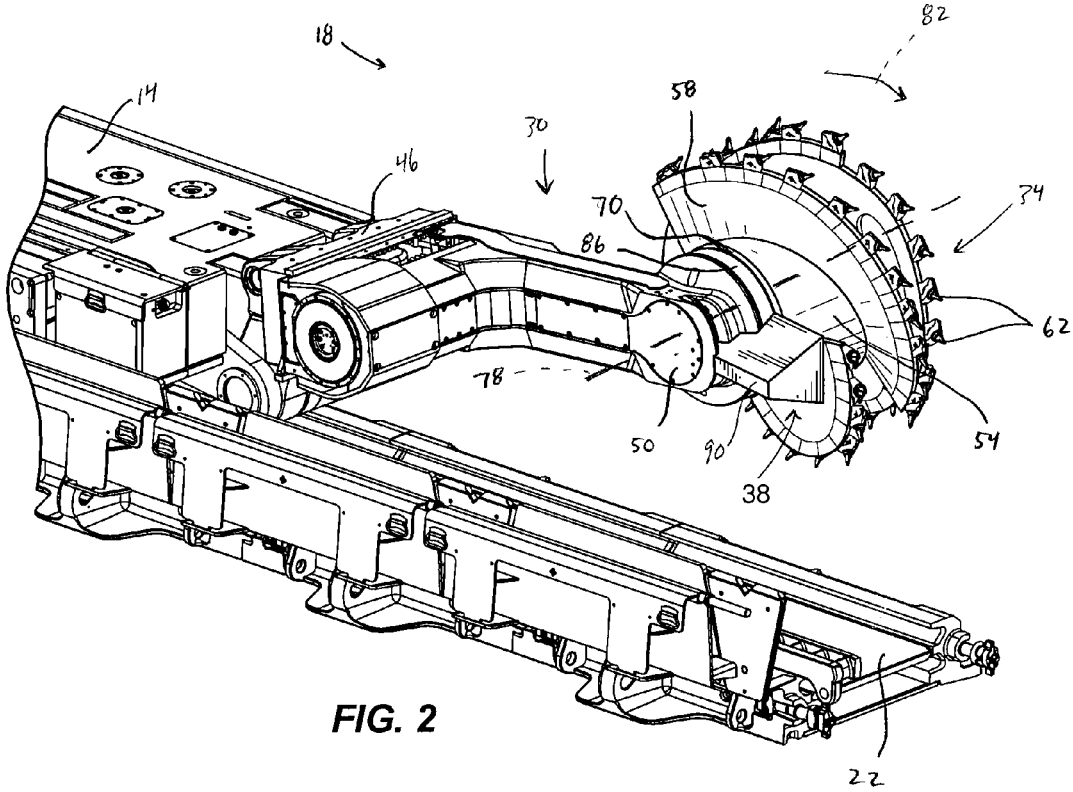
FIG. 2 is a perspective view of a cutting assembly.

FIG. 1 illustrates a longwall shearer 10 including a chassis or base 14, a pair of cutting assemblies 18, and an armored face conveyor 22 (FIG. 2). The base 14 is configured to tram along a wall (not shown) of material to be mined in a first direction 26 and a second direction 28. As the base 14 moves in the first direction 26, a first cutting assembly 18*a* is in a leading position and a second cutting assembly 18*b* is in a trailing position. The first cutting assembly 18*a* is elevated to cut material from an upper portion of the mine wall, while the second cutting assembly 18*b* is in a lower position to cut material from a lower portion of the mine wall.

Figure 3:
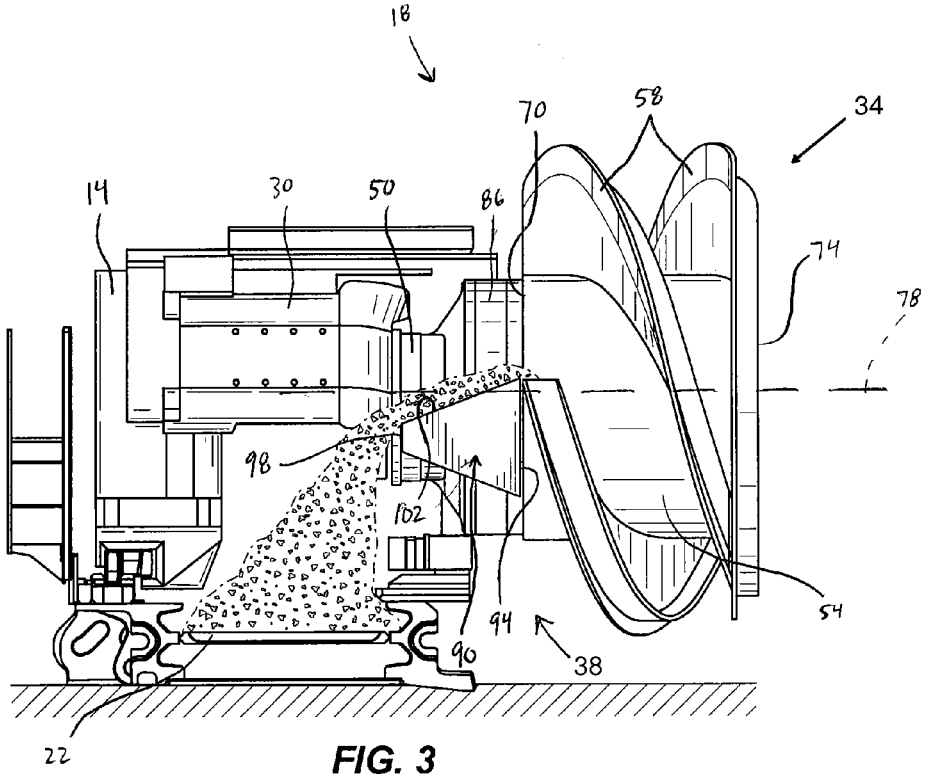
FIG. 3 is a side view of the cutting assembly of FIG. 2.

As shown in FIG. 2, each cutting assembly 18 includes a ranging arm 30, a cutting drum 34, and a guide assembly 38. The ranging arm 30 has a first end 46 pivotably coupled to the base 14 and a second end 50. Referring to FIGS. 2 and 3, the cutting drum 34 includes a generally cylindrical body 54, multiple vanes 58, and multiple cutting bits 62. The body 54 has a first end 70 and a second end 74, and a drum axis 78 is defined therebetween. The first end 70 is pivotably coupled to the second end 50 of the ranging arm 30 and has a generally planar surface. As used herein, the term "axial" and variants thereof refer to a direction parallel to the drum axis 78 and the term "radial" and variants thereof refer to a direction perpendicular to the drum axis 78.

The cutting drum 34 rotates about the drum axis 78 in a first direction 82 (FIG. 2). Each vane 58 extends in a spiral manner along the periphery of the body 54, between the first end 70 and the second end 74. The cutting bits 62 (FIG. 2) are positioned along the vanes 58.

As shown in FIGS. 2 and 3, the guide assembly 38 includes a hub 86 and a guide member 90. The hub 86 is coupled to the second end 50 of the ranging arm 30. As shown in FIG. 3, the guide member 90 includes a first end 94 adjacent the first end 70 of the body 54, a second end 98 proximate the conveyor 22, and an angled portion 102. In the illustrated embodiment, the angled portion 102 is inclined downwardly from the first end 94 toward the second end 98. In other embodiments, the angled portion 102 may include multiple facets (see, for example, FIG. 4), or may have a curved profile.

During operation of the longwall shearer 10, the base 14 travels back and forth along the mine wall. Each ranging arm 30 is pivoted about its first end 46 to move the cutting drum 34 into contact with the mine wall. The cutting drum 34 rotates about the drum axis 78 and the cutting bits 62 engage the mine wall until the shearer 10 completes a pass along the wall. The cutting bits 62 liberate material from the wall, and the material scrolls along the vanes 58, thereby transporting the material from the second end 74 of the body 54 toward the first end 70. Upon reaching the first end 70, material exits the vane 58 and engages the angled portion 102 of the guide assembly 38. In the illustrated embodiment, the material slides along the angled portion 102 from the first end 94 to the second end 98, at which point the material disengages the guide assembly 38 and falls onto the conveyor 22. The guide assembly 38 thus directs the material from the cutting drum 34 and rearwardly onto the conveyor 22. By directing material onto the conveyor 22, the guide assembly 38 may reduce the amount of material falling between the cutting drum 34 and the conveyor 22, which may be lost and/or added to the windrow. The guide assembly 38 may thereby increase the efficiency of the shearer operation.

Figure 4:
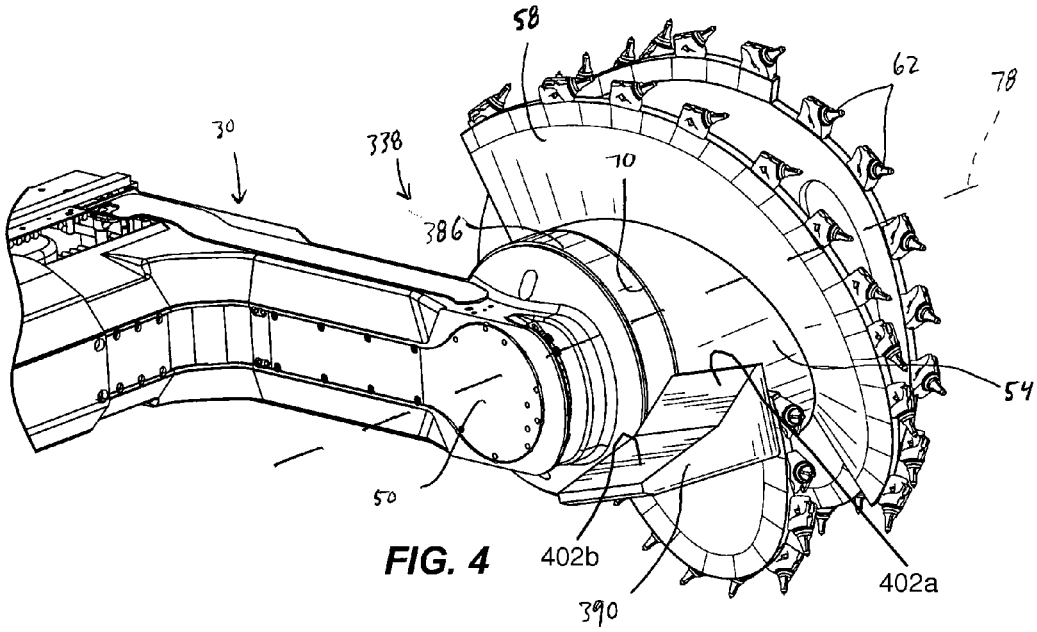
FIG. 4 is a perspective view of a cutting assembly according to another independent embodiment, with a deflector in a deployed position.
Figure 5:
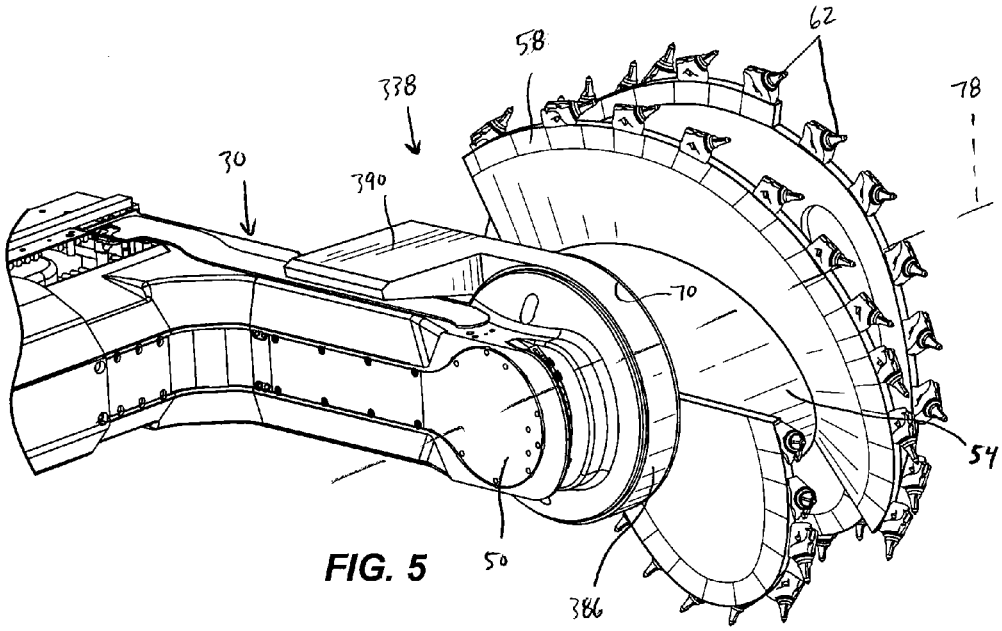
FIG. 5 is a perspective view of the cutting assembly of FIG. 4, with the deflector in a stowed position.

FIGS. 4 and 5 show another independent embodiment of the guide assembly 338. The guide assembly 338 is similar to the guide assembly 38 described above with respect to FIGS. 1-3, and only differences are described below. Common features have the same reference numbers, plus 300.

In this embodiment, the hub 386 is pivotably coupled to the second end 50 of the ranging arm 30 such that the guide member 390 can be positioned in multiple orientations with respect to the body 54 and to the arm 30. In the illustrated embodiment, the hub 386 pivots about the drum axis 78. In other embodiments (not shown), the hub 386 may pivot around an axis that is offset from the drum axis 78 and/or an axis that is not parallel to the drum axis 78.

In FIG. 4, the guide member 390 is shown in a deployed state in which the guide assembly 338 directs the material from the cutting drum 34 and rearwardly onto the conveyor 22. As the arm 30 is pivoted to position and re-position the cutting drum 34, the hub 386 may be pivoted to position/re-position the guide member 390 in an appropriate orientation to guide material onto the conveyor 22.

As shown in FIG. 4, the angled portion 402 has a first angled section 402*a* at a first angle and a second angled portion 402*b* at a second angle different than the first. In the illustrated construction, the steeper first angled section 402*a* is positioned proximate the cutting drum 34, and the shallower second angled section 402*b* is positioned proximate the conveyor 22. In other constructions (not shown), the angled portion 402 may have only one or more than two angled sections.

In FIG. 5, the guide member 390 is shown in the stowed state. In this state, the guide member 390 engages against a surface of the arm 30 (the upper surface in FIG. 5) and is generally moved out of the way. In other constructions (not shown), the guide member 390 may also be angled on its opposite surface so that any material falling on that surface also tends to move toward the conveyor 22. In still other constructions (not shown), the hub 386 could be pivoted in the opposite direction to stow the guide member 390 against the lower surface of the arm 30.

During operation, as the shearer 10 begins a new pass, the guide assembly 338 of the trailing cutting assembly 18*b* (FIG. 1) is pivoted to a deployed state (FIG. 4), and, in the deployed state, the guide assembly 338 loads material onto the conveyor 22. Meanwhile, the guide assembly 338 of the leading cutting assembly 18*a* (FIG. 1) may be pivoted to a stowed state (FIG. 5) or deployed in a different position in order to improve the loading capability of the leading cutting assembly 18*a*. With the pivotable guide assembly 338, the guide member 390 may be moved to avoid contacting roof supports during operation of the longwall shearer 10, thereby providing additional versatility for operation of shearer 10.

Figure 6:
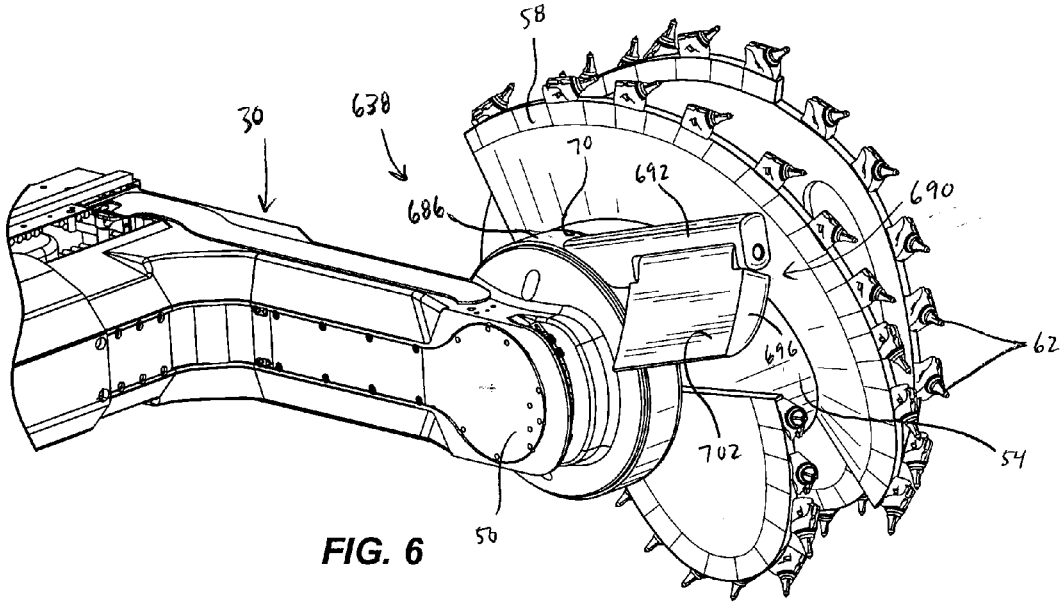
FIG. 6 is a perspective view of a cutting assembly according to another independent embodiment.
Figure 7:
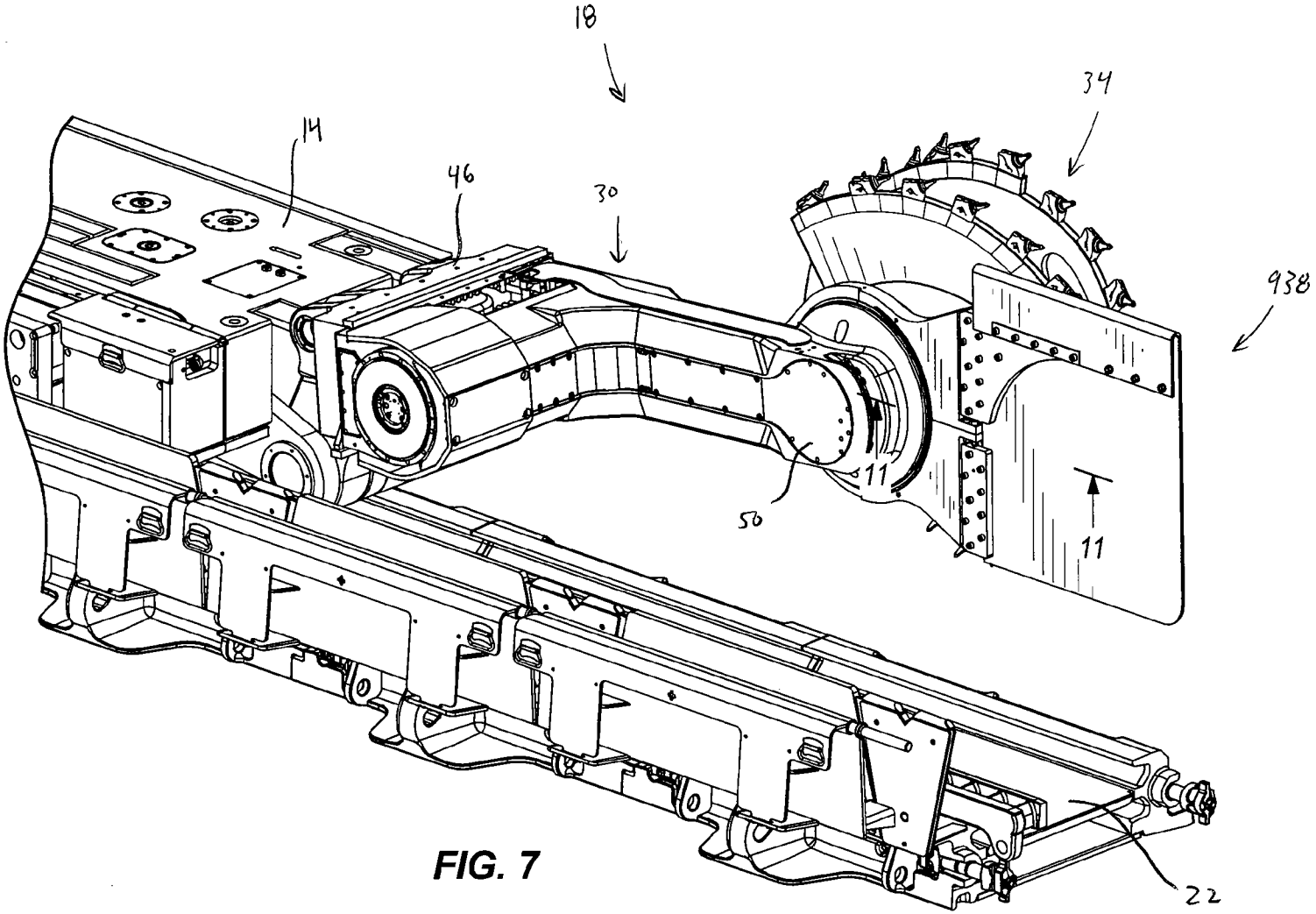
FIG. 7 is a perspective view of a cutting assembly according to another independent embodiment.

FIG. 6 shows another independent embodiment of the guide assembly 638. The guide assembly 638 is similar to the guide assembly 338 described above with respect to FIGS. 4 and 5, and only differences are described below. Common features have the same reference numbers, plus 300.

In this embodiment of FIG. 6, the guide member 690 includes an arm 692 and a wing 696 pivotably coupled to the arm 692. The wing 696 has an angled surface 702. When the guide assembly 638 is pivoted to a deployed state, the wing 696 is pivoted relative to the arm 692 to a position to receive the material exiting the cutting drum 34.

An operator can adjust the orientation of the wing 696 and the angle of the surface 702, as necessary. Pivoting movement of the wing 696 may be, for example, driven hydraulically or positioned by a spring or cam. In addition, the wing 696 can be pivoted about the arm 692 to be approximately parallel with the hub 686, allowing the guide member 690 to rotate 360° around the axis 78 and to be stowed inline with the ranging arm 30.

FIGS. 7-11 show another independent embodiment of the guide assembly 938. The guide assembly 938 is similar to the guide assembly 338 described above with respect to FIGS. 4-5, and only differences are described below. Common features have the same reference numbers, plus 600.

Figure 8:
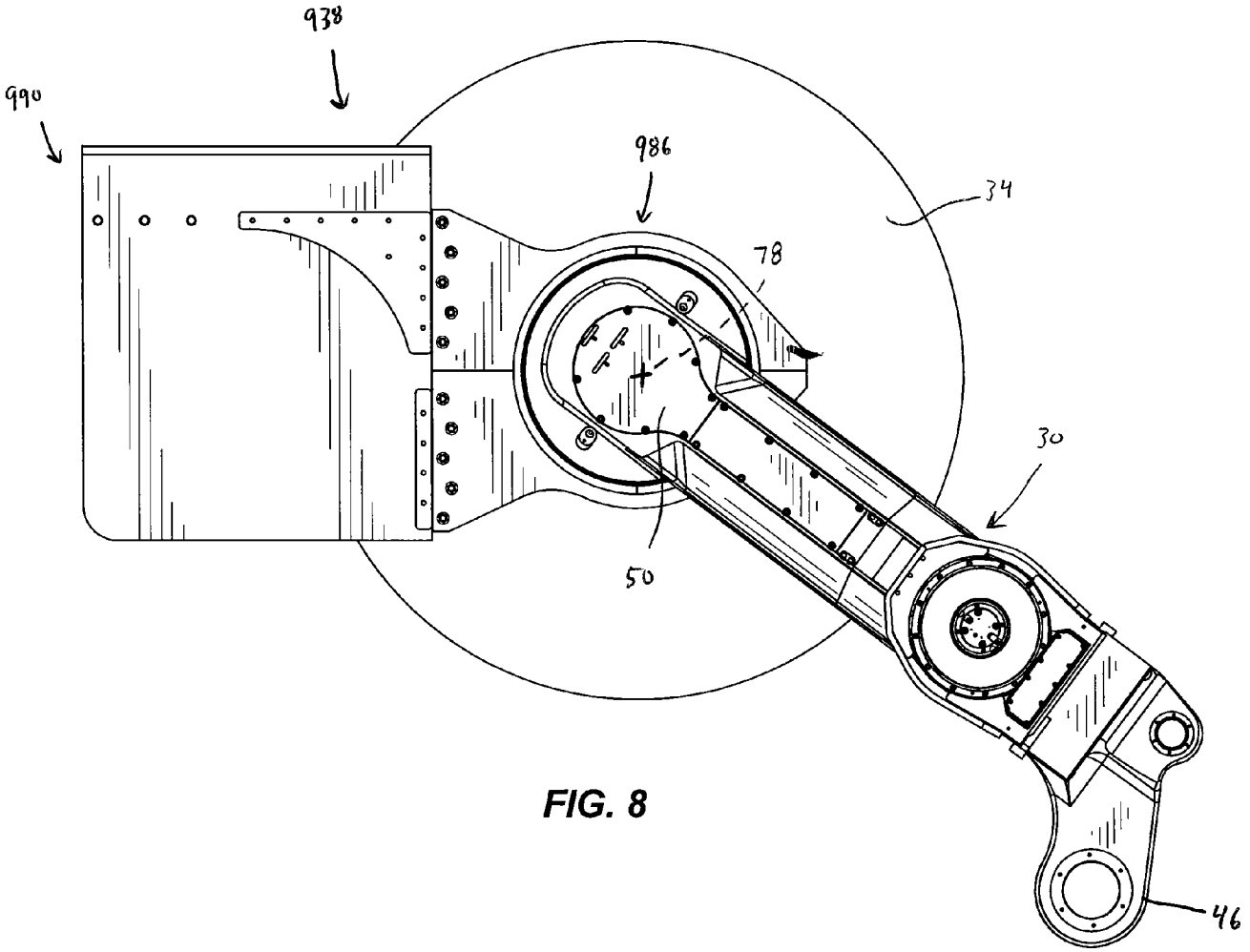
FIG. 8 is a rear view of the cutting assembly of FIG. 7.
Figure 9:
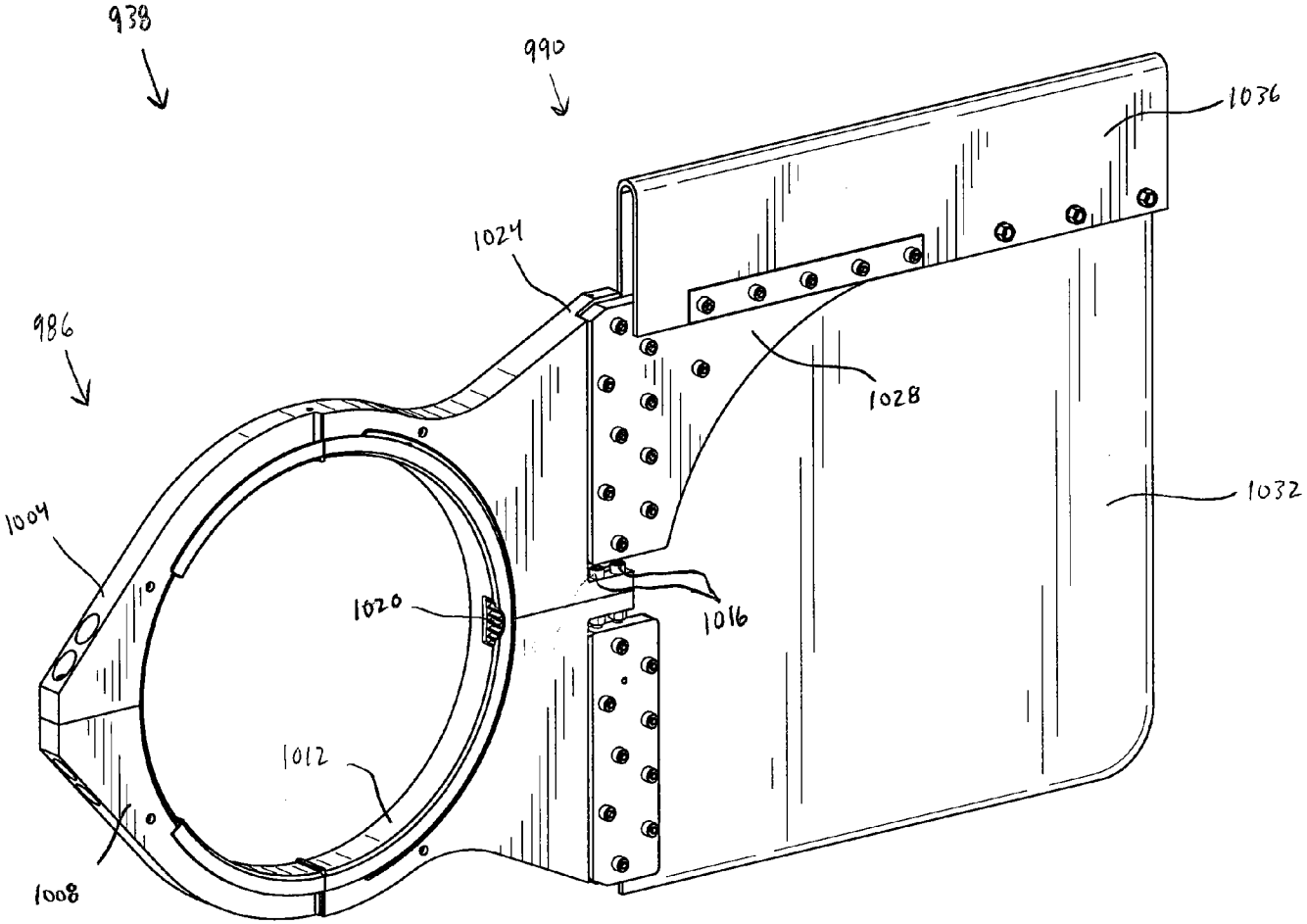
FIG. 9 is a perspective view of a deflector as shown in FIG. 7.
Figure 10:
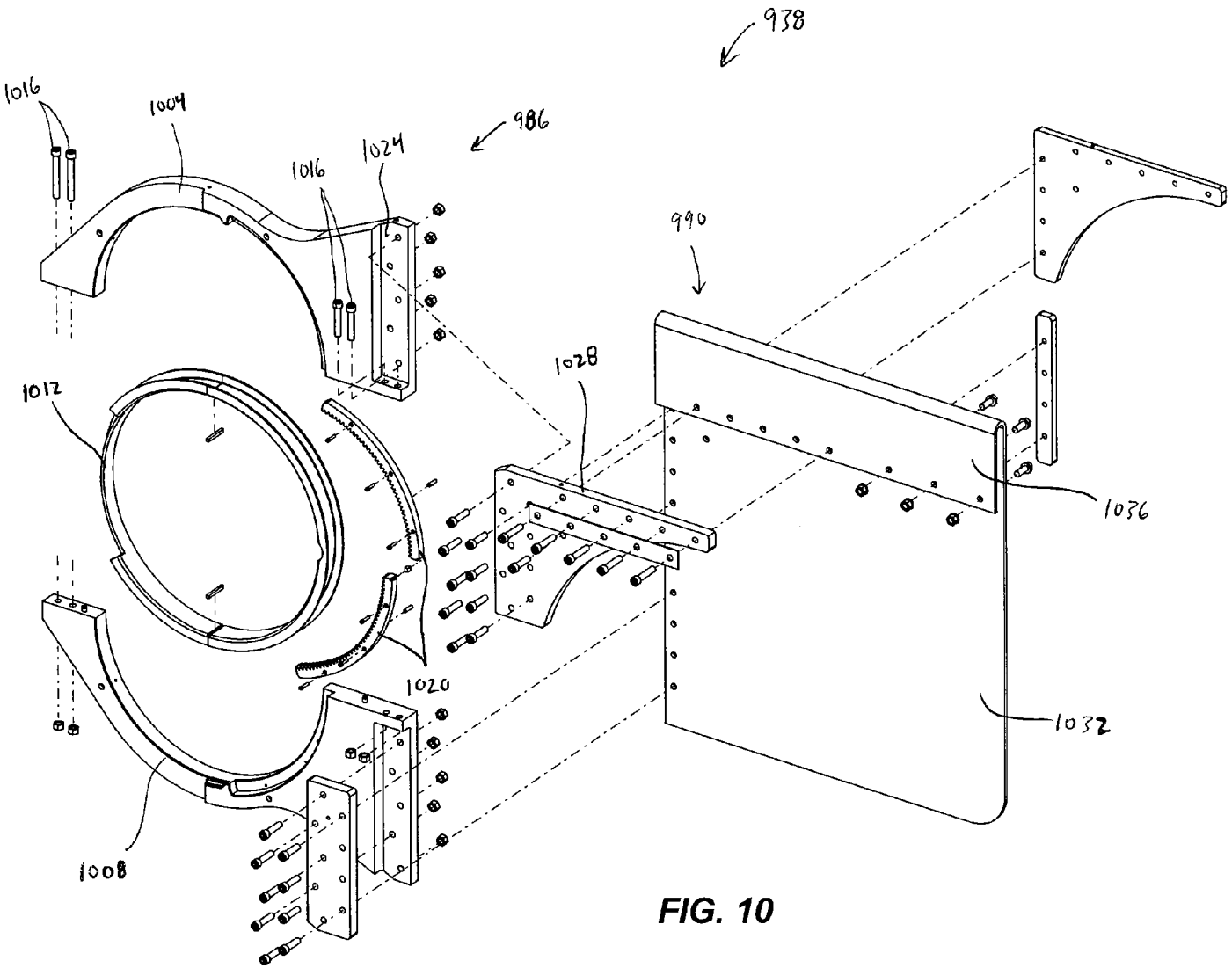
FIG. 10 is an exploded perspective view of the deflector of FIG. 9.

As shown in FIGS. 9-10, the hub 986 is formed as a top portion 1004 and a bottom portion 1008, both of which are coupled to a circular rim 1012. The top portion 1004 and the bottom portion 1008 are removably coupled together, for example, by fasteners 1016. The hub 986 includes a ring gear 1020 positioned adjacent the rim 1012, and a bracket portion 1024. In the illustrated embodiment, the ring gear 1020 extends partially along the circumference of the rim 1012. The bracket portion 1024 includes a support arm 1028 extending away from the hub 986 in a direction perpendicular to the drum axis 78 (FIG. 8).

Referring to FIGS. 9-10, the guide member 990 is formed as a flap 1032 coupled to the bracket portion 1024 and the support arm 1028. The flap 1032 generally extends away from the drum axis 78 in a radial direction. As shown in FIG. 8, the flap 1032 extends radially beyond the circumference of the cutting drum 34. The flap 1032 covers a sector of the cutting drum 34 (about 70° at the radial edge of the cutting drum 34). The flap 1032 deflects material cast by the cutting drum 34 in a direction away from the mine wall and directs that material downward toward the conveyor 22 or the mine floor, shielding the area behind the flap 1032 (e.g., the operator's station) from material that is cast by the cutting drum 34.

The flap 1032 is made from a generally flexible material so that the flap 1032 can deform when the flap 1032 comes into contact with an object or structure (e.g., a mine surface, a component of the shearer 10, a roof support (not shown), etc.). The flexible material allows the flap 1032 to absorb the impact from material without causing damage to the flap 1032.

In the illustrated construction, the flap 1032 includes an edge portion 1036 that is folded over and secured to the bracket support arm 1028. The support arm 1028 and/or the folded edge portion 1036 provide structural reinforcement for the flap 1032, preventing the edge of the flap 1032 from bending under its own weight and coming into contact the cutting drum 34.

Figure 11:
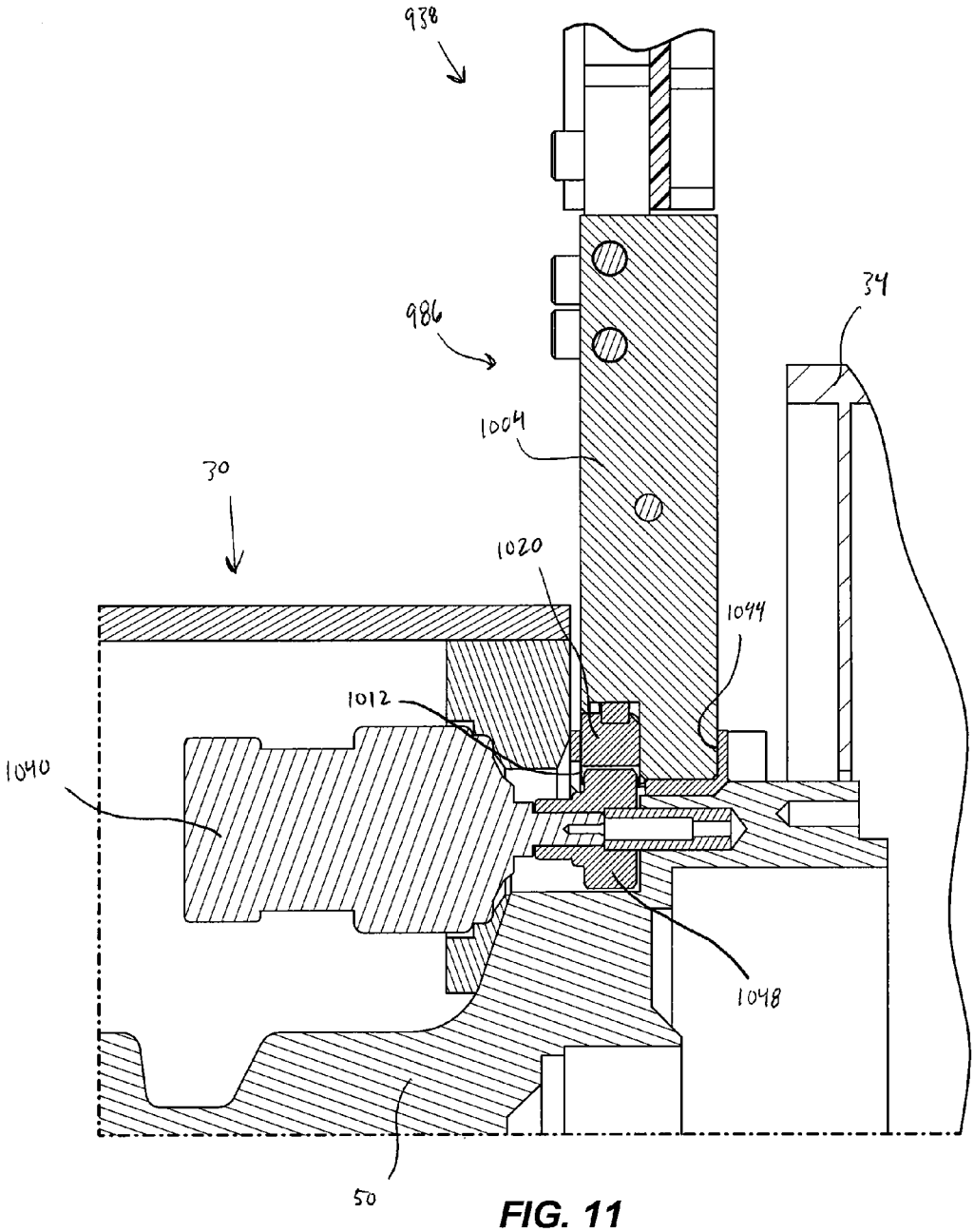
FIG. 11 is section view of the cutting assembly of FIG. 7 taken generally along line 11-11.

Referring to FIG. 11, the second end 50 of the ranging arm 34 includes a motor 1040 and a groove 1044 for receiving the rim 1012 to secure the hub 986 against movement in a direction parallel to the drum axis 78. The ring gear 1020 is also positioned within the groove 1044. The motor 1040 drives a pinion gear 1048 that engages the ring gear 1020. As the pinion gear 1048 rotates, the pinion gear 1048 moves the ring gear 1020 relative to the drum axis 78 (FIG. 8), rotating the guide assembly 938 about the drum axis 78. This allows the operator to pivot the guide member 990 to a desired position with respect to the cutting drum 34. While not shown, a similar arrangement may be provided for the pivoting hub 386 or 686, described above and shown in FIGS. 4-5 or FIG. 6, respectively.

During operation, the operator actuates the motor 1040 to move the guide assembly 938 to a desired position. The ranging arms 30 move the cutting drums 34 to engage various portions of the mine wall, including upper wall portions. As the cutting drum 34 is raised and lowered, the guide member 990 is pivoted to a desired position to provide maximum coverage of an area behind the cutting drum 34 in which liberated material is likely to be cast. The guide member 990 is positioned so that the flap 1032 does not bend or press against a mine surface, or interfere with the cutting drum 34. The flap 1032 intercepts material that is liberated from the mine wall and causes the material to fall toward the conveyor 22 or mine floor below. The flap 1032 can thus shield the operator from material that is cast from the wall.

Thus, the invention may provide, among other things, a guide assembly for a mining machine. The guide assembly may guide material away from the cutting drum toward a conveyor. The guide assembly may deflect material cast in a direction away from the mine wall.

Various independent features and independent advantages of the invention may be set forth in the following claims:

What is claimed is:

1. A guide assembly for a longwall shearer, the shearer including an arm having an arm end and a cutting drum rotatably coupled to the arm end, the cutting drum rotating about a drum axis and engaging a mine wall, the cutting drum having a rear extent arranged in a plane substantially perpendicular to the drum axis such that the drum extends from one side of the plane, the assembly comprising:

a guide member coupled to the arm and operable to guide material removed from the mine wall, the guide member extending substantially perpendicular to the drum axis and positioned on another side of the plane opposite the cutting drum.

2. The assembly of claim 1, wherein the guide member has a guide surface extending in a direction non-parallel to the plane and non-parallel to the drum axis, the guide member guiding material along the guide surface away from the cutting drum.

3. The assembly of claim 2, further comprising a hub portion coupled to the arm and pivotable about a hub axis between a stowed position and a deployed position, the guide member being connected to and pivotable with the hub portion, the guide member being operable to guide material in the deployed position of the hub portion.

4. The assembly of claim 1, wherein the guide member has a guide surface extending substantially parallel to the plane, the guide member deflecting material traveling in a direction non-parallel to the plane.

5. The assembly of claim 4, wherein the guide member is formed at least partially of a flexible material.

6. The assembly of claim 4, further comprising a hub portion coupled to the arm and pivotable about a hub axis, the guide member being connected to and pivotable with the hub portion.

7. A guide assembly for a longwall shearer, the shearer including an arm having an arm end and a cutting drum rotatably coupled to the arm end, the cutting drum rotating about a drum axis and engaging a mine wall, the cutting drum having a rear extent arranged in a plane substantially perpendicular to the drum axis such that the drum extends from one side of the plane, the assembly comprising:

a guide member coupled to the arm and operable to guide material removed from the mine wall, the guide member having a guide surface defining a guide plane non-parallel to the plane of the rear extent and non-parallel to the drum axis, the guide surface positioned on another side of the plane opposite the cutting drum, the guide member guiding material along the guide surface away from the cutting drum.

8. The assembly of claim 7, wherein the guide member is fixed to the arm.

9. The assembly of claim 7, further comprising a hub portion coupled to the arm and pivotable about a hub axis between a stowed position and a deployed position, the guide member being connected to and pivotable with the hub portion, the guide member being operable to guide material in the deployed position of the hub portion.

10. The assembly of claim 9, wherein, in the stowed position of the hub portion, at least a portion of the guide surface is engageable with a surface of the arm.

11. The assembly of claim 7, wherein the guide surface has a first portion at a first angle relative to the drum axis and a second portion at a second angle relative to the drum axis, the first angle and the second angle being different.

12. The assembly of claim 11, wherein the first angle is greater than the second angle.

13. The assembly of claim 12, wherein the first portion is proximate the cutting drum and the second portion is spaced from the cutting drum.

14. A guide assembly for a longwall shearer, the shearer including an arm having an arm end and a cutting drum rotatably coupled to the arm end, the cutting drum rotating about a drum axis and engaging a mine wall, the cutting drum having a rear extent arranged in a plane substantially perpendicular to the drum axis such that the drum extends from one side of the plane, the assembly comprising:

a hub portion coupled to the arm and pivotable about a hub axis; and a guide member connected to and pivotable with the hub portion, the guide member extending perpendicular to the drum axis and positioned on another side of the plane opposite the cutting drum, the guide member including a flap formed at least partially of a flexible material, the flap configured to deflect material removed from the mine wall and traveling in a direction non-parallel to the plane.

15. The assembly of claim 14, wherein the guide member includes a frame supporting the flap.

16. The assembly of claim 14, wherein the flap extends radially beyond the cutter drum.

17. The assembly of claim 14, wherein the arm extends along an arm axis and has an arm width transverse to the axis and parallel to the plane, and wherein the flap has a height greater than the arm width.

18. The assembly of claim 17, wherein the height of the flap is at least one and a half times the arm width.

19. The assembly of claim 14, further comprising a drive mechanism operable to pivot the hub portion.

20. A longwall shearer for engaging a mine wall, the shearer comprising:

a body;

an arm including a first end coupled to the body and a second end;

a cutting drum rotatably coupled to the arm end, the cutting drum rotating about a drum axis and engaging a mine wall, the cutting drum having a rear extent arranged in a plane substantially perpendicular to the drum axis such that the drum extends from one side of the plane; and a guide member coupled to the arm and operable to guide material removed from the mine wall, the guide member extending substantially perpendicular to the drum axis and positioned on another side of the plane opposite the cutting drum.

21. The shearer of claim 20, wherein the guide surface is angled downwardly and away from the mine wall, the guide member guiding material toward a conveyor operable to transport the material away from the mine wall.

22. The shearer of claim 21, further comprising a hub portion coupled to the arm and pivotable about a hub axis between a stowed position and a deployed position, the guide member being connected to and pivotable with the hub portion, the guide member being operable to guide material in the deployed position of the hub portion.

23. The shearer of claim 22, wherein, in the stowed position, at least a portion of the guide surface engages a surface of the arm.

24. The shearer of claim 20, wherein the guide member has a guide surface extending substantially parallel to the plane, the guide member deflecting material traveling in a direction non-parallel to the plane.

25. The shearer of claim 24, wherein the guide member is formed at least partially of a flexible material.

26. The shearer of claim 24, further comprising a hub portion coupled to the arm and pivotable about a hub axis, the guide member being connected to and pivotable with the hub portion.

27. The shearer of claim 26, wherein the hub portion further includes a ring gear engaging a motor coupled to the arm end, and wherein the hub portion is rotated by operating the motor to pivot the ring gear.

28. The shearer of claim 14, wherein the flap extends along a sector of the cutting drum of approximately 70 degrees about the drum axis.

* * * * *